US008370970B2

(12) United States Patent
Reavis

(10) Patent No.: US 8,370,970 B2
(45) Date of Patent: Feb. 12, 2013

(54) SNAP-IN QUICK REMOVAL POP-UP DRAIN STOPPER

(76) Inventor: Richard Martin Reavis, Tucson, AZ (US)

( * ) Notice: Subject to any disclaimer, the term of this patent is extended or adjusted under 35 U.S.C. 154(b) by 84 days.

(21) Appl. No.: 13/024,317

(22) Filed: Feb. 9, 2011

(65) Prior Publication Data

US 2012/0199213 A1 Aug. 9, 2012

(51) Int. Cl.
*E03C 1/232* (2006.01)

(52) U.S. Cl. ..... 4/684

(58) Field of Classification Search ..... 4/679, 684
See application file for complete search history.

*Primary Examiner* — Lori Baker

(57) ABSTRACT

This device incorporates a new method for attachment of a pop-up drain stopper to the pivot rod which controls its mechanical motion as is typical in bathroom sinks, thereby providing the consumer with a simple and convenient method of removing and installing the stopper as is needed for extraction of drain clogs. As shown in FIG. 5, the stopper is inserted into the drain with the connecting journal channel opening (6) positioned over the pivot rod (8). Downward pressure is applied (FIG. 6) forcing the pivot rod to pass through the channel and snap into the connecting journal (FIG. 7). Transversely, by pulling upward, the stopper disengages from the pivot rod and is removed from the drain opening. By incorporating two or more conjoined connecting journals in an elongated connecting bracket (FIG. 8), the stopper can accommodate a wider range of pivot rod placement.

1 Claim, 3 Drawing Sheets

Front View

Side View

Top View

Bottom View

Physical Actions of the Connecting Apparatus During Installation

Connecting Bracket Incorporating Two Linked Connecting Journals to Accommodate Various Pivot Rod Mounting Locations

SNAP-IN QUICK REMOVAL POP-UP DRAIN STOPPER

BACKGROUND OF THE INVENTION

The present invention is directed to the device of pop-up bathroom sink drain stopper, the up and down function of which is controlled by a horizontal pivot rod mounted through the drain pipe wall and extending through a hole penetrating the lower end of the stopper body thereby securing the stopper in place within the drain pipe. The specific problem in the prior art to which the present invention is drawn, is the necessity of the under the sink disassembly of the mechanical apparatus and removal of the pivot rod in order to extract the current typical stopper from the drain as is required to properly remove a clog.

SUMMARY OF THE INVENTION

The present invention solves the specific problem of the prior art through an improvement of the stopper body apparatus and method by which the stopper is connected to the pivot rod thus providing a quick and convenient means of removal and reinstallation. Positioned at the bottom of the stopper body, the present invention employs a vertical connecting bracket with a pivot rod connecting journal having an opening at the bottom center point of its perimeter which extends vertically beyond the exterior bottom edge of the connecting bracket thereby creating a channel through which the pivot rod enters the journal. The channel is of a diameter slightly less than that of the pivot rod causing a restriction which prevents the rod from disengaging during normal use. The interior and exterior edges of the channel opening are radiused to assist in guidance and passage of the pivot rod into and out of the journal. Installation is accomplished by inserting the stopper into the drain opening with the journal channel opening positioned over the pivot rod and applying downward pressure to the top of the stopper causing the pivot rod to forcefully pass through the channel restriction and enter the journal thereby connecting the stopper to the pivot rod. Removal is achieved by pulling upward on the stopper causing the pivot rod to exit the journal thus disengaging the stopper and permitting its extraction from the drain opening allowing unobstructed access for drain clog removal. A clogged bathroom sink drain is something most consumers experience several times a year. The involved process of removing the current typical pop-up stopper to effectively address a clog is inconvenient at least, if not beyond the capability of the average consumer. The present invention provides an easy, simple and convenient solution to this common problem.

DETAILED DESCRIPTION OF THE INVENTION

When inserted into the opening of a drain of the type employing a pivot rod to control the up and down motion of the stopper, as is commonly found in a bathroom sink, and positioning the invention with the opening of the Connecting Bracket (4) vertically above the pivot rod, downward pressure applied to the Top Plate (1) causes the pivot rod to forcefully pass through the Journal Channel (6) and enter the Connecting Journal (5) thereby securing the stopper to the pivot rod. The Main Body (3) consists of Lateral Fins (7) radiating from a central vertical axis and are of a radius of such that their combined diameter is slightly less than that of the inside diameter of the drain pipe and serve to center the device within the drain. A Gasket (2) positioned below the Top Plate prevents water leakage when the device is closed.

Figure 1:
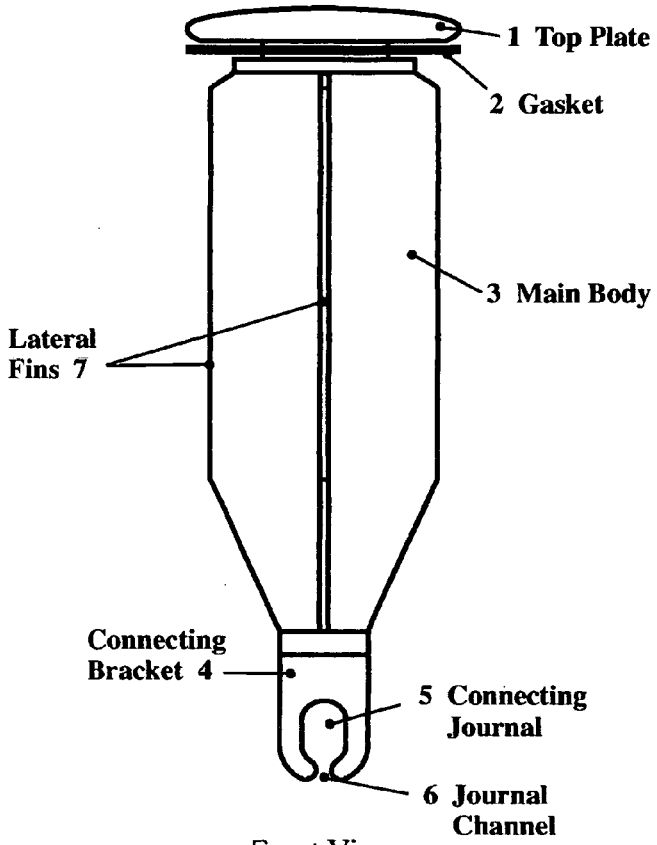
FIGS. 1-4 depict the front, side, top and bottom views of snap-in quick removal pop-up drain stopper embodying the principals of the present invention.
Figure 2:
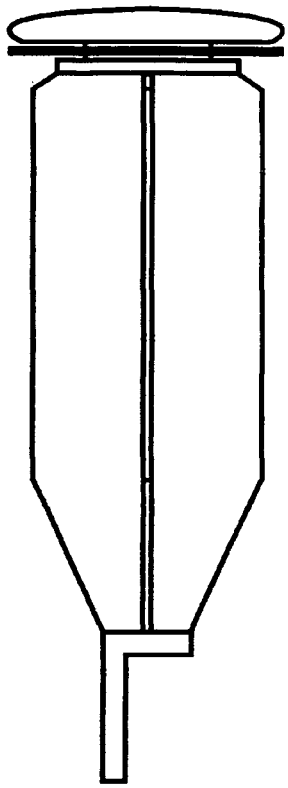
Figure 3:
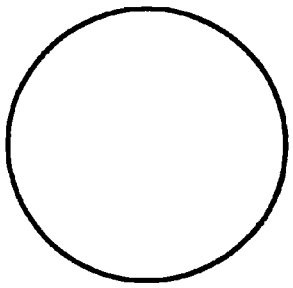
Figure 4:
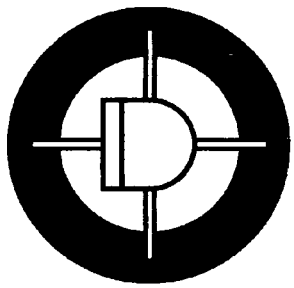
Figures 5, 6, 7:
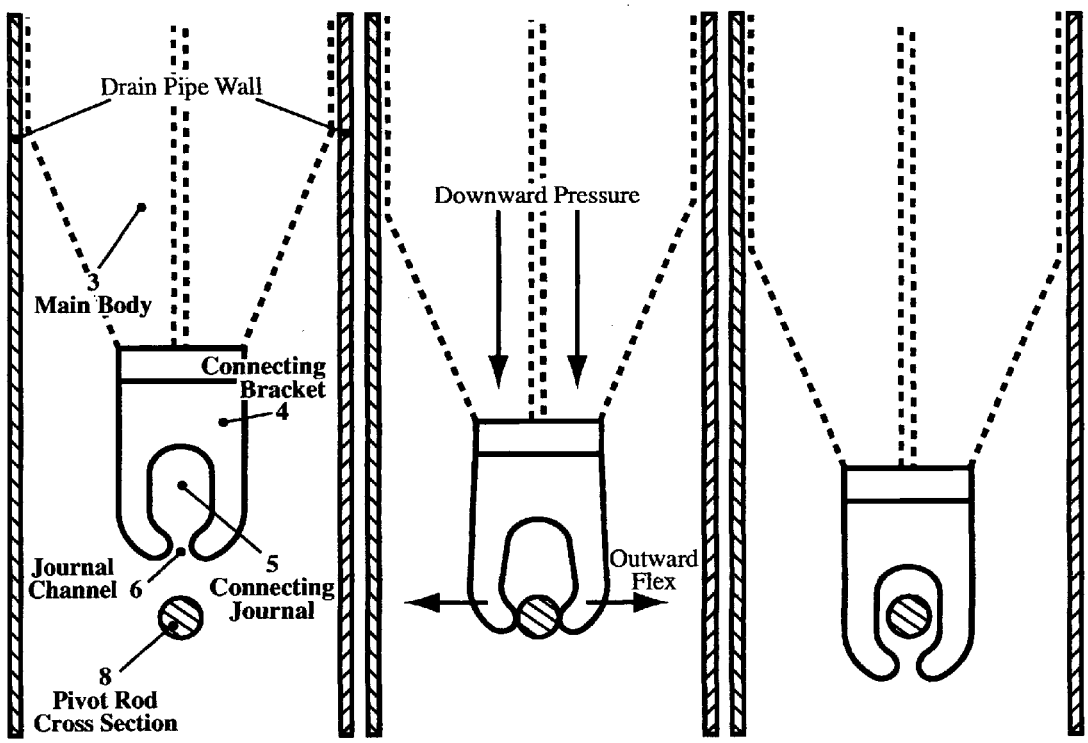
FIGS. 5-7 demonstrate the physical actions of the present invention and its method and means of attachment to the pivot rod during installation.

The present invention should be constructed of plastic or a similar material of sufficient flexibility, as illustrated in FIGS. 5-7, to allow the passage of the Journal Channel (6) to outwardly flex and accommodate the greater diameter of the Pivot Rod (8) as it is forced into the Connecting Journal (5) during the installation process. The material of construction must also possess the physical properties necessary for the Journal Channel to return to and maintain its original shape and configuration with appropriate rigidity to prevent the Pivot Rod from exiting the Connecting Journal under normal operating conditions unless sufficient upward force is applied to the device as is required for its removal.

Figure 8:
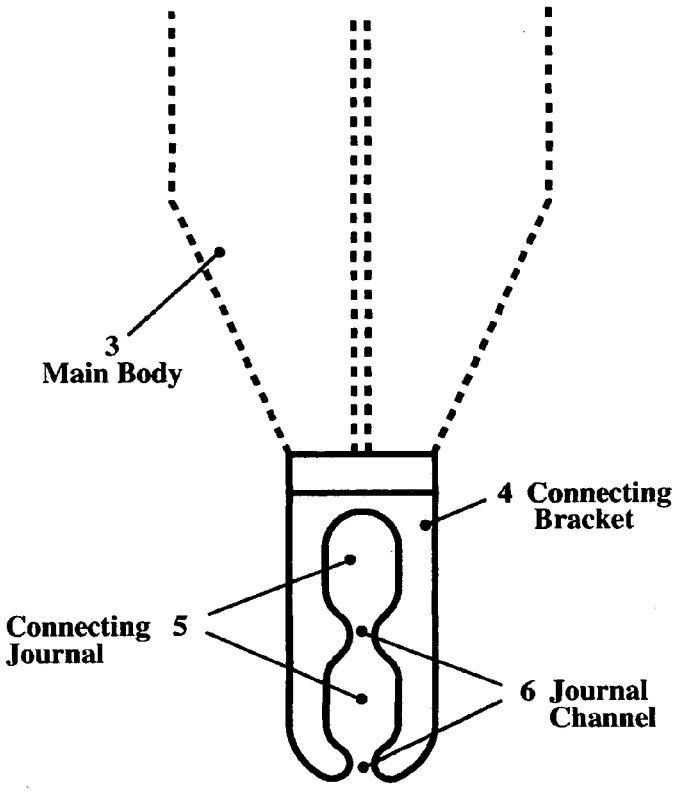
FIG. 8 depicts a configuration of the present invention employing multiple journals to accommodate varying pivot rod locations.

As demonstrated in FIG. 8, the Connecting Bracket (4) could be configured with additional Connecting Journals (5) positioned in vertical alignment and in spatial contact through vertically aligned Journal Channels (6) allowing the invention to accommodate various pivot rod locations.

What is claimed as being new and desired for patent protection is:

1. A method providing for the snap-in installation and quick removal of a pivot rod controlled pop-up drain stopper, said device comprising:

a stopper main body consisting of a circular horizontal top plate the neck of which extends downward through the center of a circular gasket and connects to the top surface of elongated vertical laterally radiating fins;

a vertical connecting bracket positioned at and connected to the bottom of the main body penetrated by one or more connecting journal(s) to accommodate the diameter of the pivot rod and positioned along the vertical axis of the device;

a vertical journal channel originating beyond the bottom physical perimeter of the connecting bracket and in center alignment with and extending beyond the physical perimeter of the connecting journal(s) and of a diameter less than that of the pivot rod creating a restrictive spatial passage through which the pivot rod can travel when force is applied and enter the connecting journal(s);

snap-in installation achieved by inserting the device into the drain and positioning the journal channel opening over the pivot rod and applying downward pressure to the top of the device forcing the pivot rod to pass through the journal channel and enter the connecting journal;

quick removal achieved by grasping the top of the device and pulling upward, causing the pivot rod to exit the connecting journal disengaging the device from the pivot rod allowing it to be removed from the drain pipe.

* * * * *